US006905447B1

(12) United States Patent
Walter

(10) Patent No.: US 6,905,447 B1
(45) Date of Patent: Jun. 14, 2005

(54) REHABILITATION DEVICE

(76) Inventor: Klaus Walter, Bippenwaldstrasse 5, Kiefersfelden (DE), D-83088

( * ) Notice: Subject to any disclaimer, the term of this patent is extended or adjusted under 35 U.S.C. 154(b) by 0 days.

(21) Appl. No.: 09/807,617

(22) PCT Filed: Oct. 26, 1999

(86) PCT No.: PCT/EP99/08073

§ 371 (c)(1),
(2), (4) Date: May 14, 2001

(87) PCT Pub. No.: WO00/24345

PCT Pub. Date: May 4, 2000

(30) Foreign Application Priority Data

Oct. 26, 1998 (DE) ..... 298 19 060 U

(51) Int. Cl.[7] ..... A63B 23/02
(52) U.S. Cl. ..... 482/121; 482/904; 482/97
(58) Field of Search ..... 602/32, 36, 19; 2/44, 45, 94; 224/628, 683, 635, 265, 266; 482/907, 105, 124, 23, 32, 10, 904, 66, 121

(56) References Cited

U.S. PATENT DOCUMENTS

| | | | | |
|---|---|---|---|---|
| 786,672 | A | | 4/1905 | Peund |
| 1,722,192 | A | | 7/1929 | Brokaw |
| 1,733,349 | A | | 10/1929 | Koeber |
| 4,139,132 | A | * | 2/1979 | Fairchild, Jr. |
| 4,402,441 | A | * | 9/1983 | Jones et al. |
| 4,986,536 | A | * | 1/1991 | Zane |
| 5,460,587 | A | | 10/1995 | Hutchins |

FOREIGN PATENT DOCUMENTS

| | | |
|---|---|---|
| DE | 76054 | 7/1894 |
| DE | 103 713 | 7/1898 |
| DE | 213 282 | 10/1909 |
| DE | 316 452 | 11/1919 |
| DE | 23 46 678 | 3/1975 |
| DE | 38 44 233 | 7/1990 |
| DE | 39 04 489 | 8/1990 |
| DE | 298 18 369 | 1/1999 |
| FR | 405 687 | 1/1910 |

* cited by examiner

*Primary Examiner*—Jerome W. Donnelly
(74) *Attorney, Agent, or Firm*—Nixon & Vanderhye P.C.

(57) ABSTRACT

An improved rehabilitation device for treating a hump back and forward drooping shoulders has a base section with a support which can be put on the back of a patient. The support is arranged or configured in a transverse direction to the longitudinal axis of the rehabilitation device. A function unit is provided above the support, including two counter supports that face the support and are offset in relation to one another. The rehabilitation device is provided with a release section by which the two counter supports can be swiveled around the swivel axis formed by the support.

22 Claims, 6 Drawing Sheets

REHABILITATION DEVICE

This application is the U.S. national phase of International PCT Application No. PCT/EP99/08073, filed Oct. 26, 1999, which designated the United States. PCT/EP99/08073 claims priority of German Patent Application No. 29819060.5, filed Oct. 26, 1998. The entire contents of these applications are herein incorporated by reference.

BACKGROUND OF THE INVENTION

The device relates to a rehabilitation device for straightening a hump back and/or to stretch and straighten the front shoulder part.

Back and shoulder stretching devices have already become known, such as from DE 298 18 369 A1, that are used to be able to perform self treatment when there are back pains caused by strain.

SUMMARY OF THE INVENTION

But such training devices are not suitable for use if a so-called hump-back or drooping shoulders are to be treated.

Thus the object of the invention is to provide a rehabilitation device with which it is possible again to straighten a dorsal spine curved due to illness. The same also applies if drooping shoulders are to be treated.

The object is achieved according to the invention according to the features indicated in claim 1. Advantageous configurations of the invention are indicated in the subclaims.

The invention proposes a rehabilitation device that is designed relatively simply and with which the patient also can do exercises on his own to slowly, increasingly straighten his more or less greatly curved dorsal spine (hump back) and/or drooping shoulders.

The rehabilitation device is thus built like a rocker that can be swiveled around a support that can be put on the back, and the support or the swivel axis formed by it lies crosswise to the longitudinal direction of the body. Pulling elements can be provided or made in various ways at the top end of the rehabilitation device so that, in conjunction with a counter-support, they press on the upper front part of the drooping shoulder part. For example, the patient himself can raise the pressure on the shoulder part by lower actuation or pulling elements so that the drooping shoulder is straightened relative to the support placed on the back.

The rehabilitation device can be designed in many ways.

In a simple embodiment, the pulling elements that act on the shoulder part can consist of loops. But also possible are designs using rods, straps, etc., that are guided to the front over the shoulder from the back side of the base section of the rehabilitation device and on whose ends are placed the mentioned counter-supports acting on the shoulder.

The strap design here can consist of several adjustable individual straps to be able to optimally adjust the support in height and relative position according to individual needs.

As an actuation device, for example, actuation rods passing by the side of the body going forward can be connected with the rehabilitation device's base section, which includes the rear support. A slight pulling can then appropriately raise and lower the corresponding pressure on the forward-drooping shoulder part to straighten the back. Likewise, cords, for example, can be put on these actuations sections, and they are fastened for example to corresponding hooks on a wall so that a slight rearward movement automatically places tension on the actuation elements and thus the desired pressure is raised on the left and right drooping shoulder area as well as on the hump back.

The rehabilitation device according to the invention is distinguished, inter alia, for example in preferred embodiments, by the following characteristics or features:

- The rehabilitation device can consist of a double arc, both of whose individual arc sections are stabilized with one another by cross struts. Padding can preferably be attached, in particular on the inner side of the curve in each case, at the intersections of the two.
- The double arcs consisting of two individual arcs can exhibit a narrow semicircle curve and a broad semicircle curve, and both arc sections can run at least approximately parallel and be open toward one side (namely toward the front).
- The arc sections can have one or more holes to which, for example, the mentioned cross struts and/or the padding can be attached in various positions to arcs or struts.
- To brace it on the shoulder area and/or on the back, the padding can be supported in each case by a lath. The padding, in particular the part lying against the chest, can be fitted to the chest part. The padding that can be put crosswise over the back and act as a rocker support can, with the struts running lengthwise and designed as a semicircular curve, be attached facing inward (i.e., facing the back) on the side struts and thus span the overall crosswise distance between the side struts or double arcs. Preferably here also a support base is used that supports the rocker-like support.
- On the lower end of the lateral struts, in particular of the struts describing large curves, loops or rings can be made or attached, to which pulling devices can be attached.
- The individual parts mentioned, in particular the lateral struts also in the shape of arcs, and the one or more cross struts, can consist of metal, plastic, or wood. They can be solid or be equipped like pipes or the like. The mentioned padding preferably comprises an elastic core and can be covered with fabric, leather, plastic, or the like.

BRIEF DESCRIPTION OF THE DRAWINGS

The invention will be described in more detail below based on embodiments. There are shown in.

The invention will be described in more detail below with reference to the drawings, in which.

DETAILED DESCRIPTION OF PREFERRED EMBODIMENTS

Figure 1:
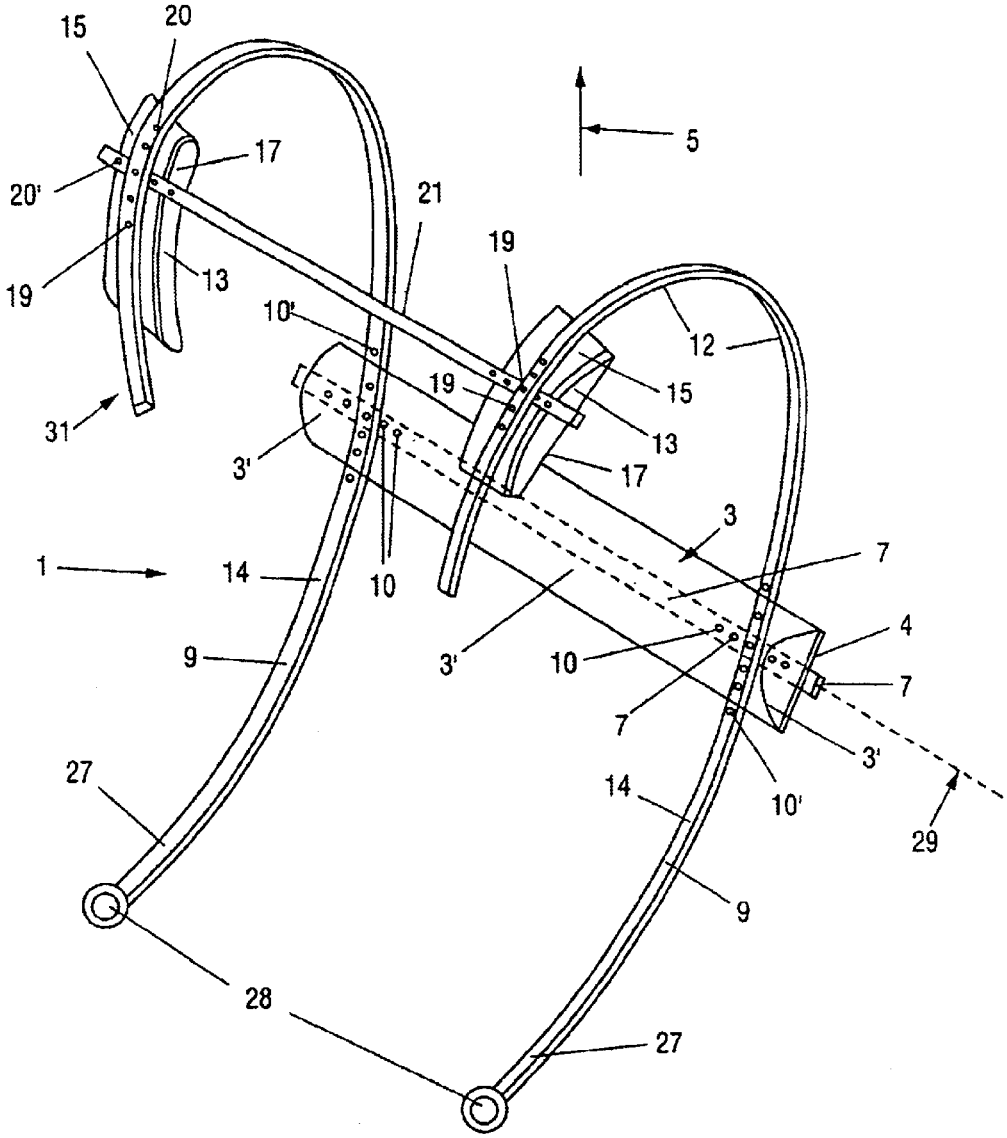
FIG. 1, a first embodiment according to the invention of a rehabilitation device in a diagrammatic perspective representation.
Figure 2:
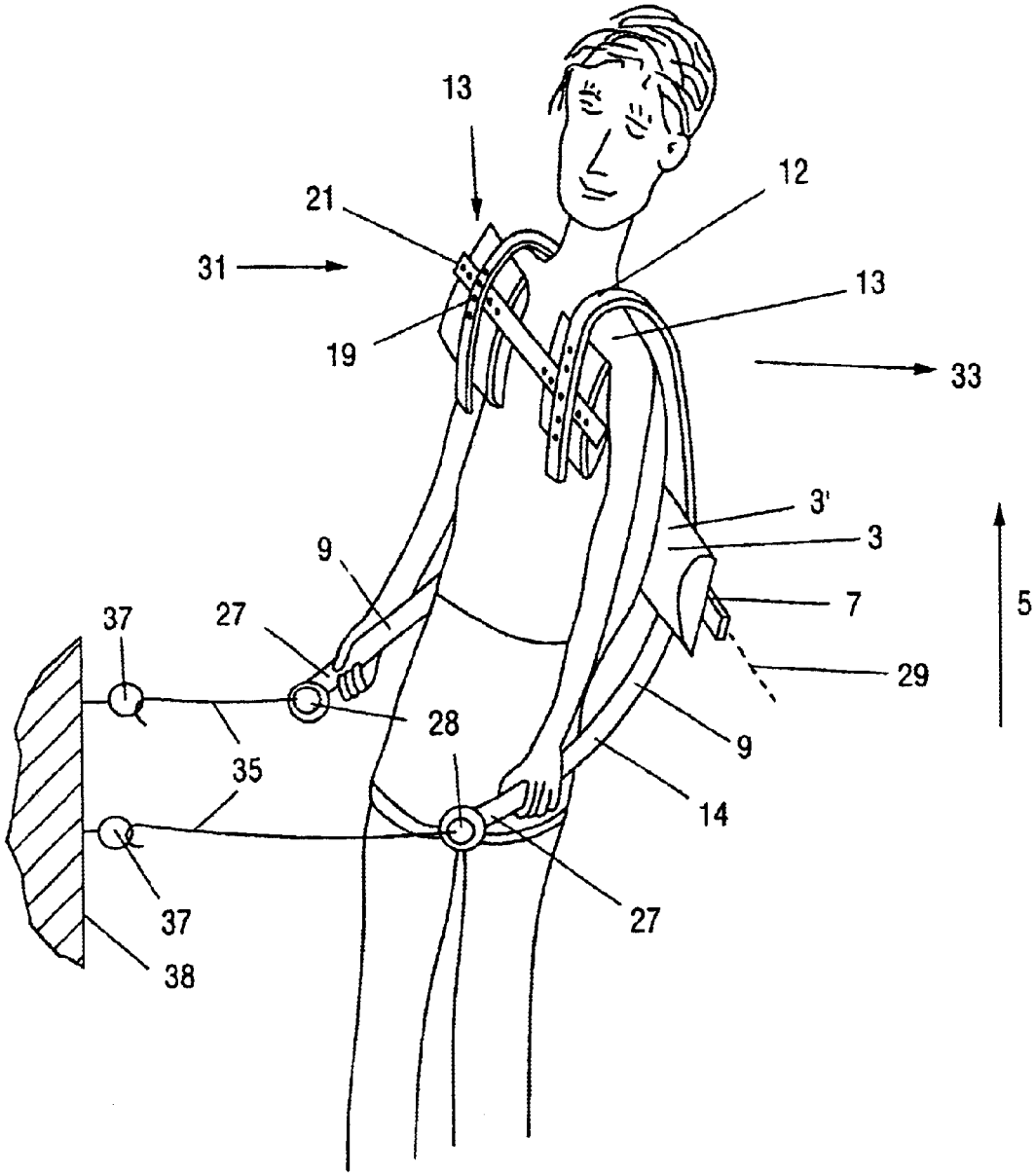
FIG. 2, a corresponding representation with the rehabilitation device shown in FIG. 1 placed on a patient.

As can be seen from FIG. 1, the rehabilitation device according to the embodiments of FIGS. 1 and 2 consists of a base section 1 that essentially comprises a support 3. In the embodiment shown, support 3 is placed crosswise to the longitudinal axis or lengthwise dimension 5 of the rehabilitation device. When placed on a patient, longitudinal axis or lengthwise dimension 5 runs parallel to the lengthwise dimension of the body, i.e., generally parallel to the vertical direction.

Support 3 can be provided with a continuous, crosswise support surface 3' that has a convex, light padding in the vertical cross section. But likewise it can also consist of at least two individual padded elements placed offset in the crosswise direction or, for example, of several individual padded elements 3 placed next to one another in the crosswise direction.

In the embodiment shown, the soft or elastic support is supported and braced by a base plate 4.

A support 3 designed this way is held and fastened by a suitable supporting structure, in the embodiment shown by a connecting strut 7 located on the inner side or on the rearward back side of support 3 or base plate 4 and attached to actuation struts 9 lying opposite one another essentially in the longitudinal direction and running parallel to one another.

In the embodiment shown according to FIG. 1, both actuation struts 9, placed laterally offset to one another, are designed the same way and exhibit a stirrup-like, i.e., curved shape. Connecting strut 7 mentioned in support 3 can be fixed by a suitable detachable and attachable adjusting mechanism 11 in various positions along actuation struts 9, to be able to adapt to individual needs.

For this purpose, holes 10, for example, can be made in the longitudinal arcs or in actuation struts 9 and/or in mentioned cross strut 7, holes through which the screw-shaped fixed means can be inserted and fastened. In this way, the relative position of cross struts 7 can be variably adjusted in a different position in the longitudinal direction of actuation struts 9 and/or the spacing distance between both lateral actuation struts 9 can be variably adjusted by bringing corresponding holes 10 in the cross strut or holes 10' in the longitudinal struts into the desired relative position in corresponding alignment and by inserting the fixing device, preferably consisting of screw bolts, and securing them from the rear side by nuts.

It can be seen from FIG. 1 that actuation struts 9 are shaped in a narrower arc section 12 on top and in a broader arc section 14 on the bottom. In the embodiment shown, actuation struts 9 go toward the front in an arc shape on their top end. There, counter-supports 13 are made or provided, and in the embodiment shown they can consist of a pressure or support base 15 opposite which corresponding padded elements 17 are located in padded support surface 3' of support 3.

Counter-supports 13 can also be adjusted by suitable adjusting and fixing devices 19 in a variable relative position relative to actuation struts 9 to make it possible to adapt to individuals.

To secure both actuation struts 9, in addition to mentioned connecting strut 7 one or more additional connecting struts can be provided at suitable points, for example, in the embodiment shown according to FIG. 1, in the front end area of arc-shaped actuation struts 9, and specifically here, for example, at the height of counter-supports 13. This makes it possible for counter-supports 13 to be attached, for example, not necessarily to actuation struts 9 directly but, e.g., to an ancillary strut 21 attached to them by mentioned adjustment and fixing device 19, so that counter-supports 13 can be attached by their adjustment and fixing device 19 at varying lateral distance from one another and fixed to connecting strut 21 and, for example, connecting strut 21 can be attached by another adjustment and fixing device in varying longitudinal position to actuation struts 9. The mentioned fixing device also consists here, like, e.g., the device that fastens cross strut 7 to lateral, arc-shaped longitudinal struts 9, of numerous holes 20 in both longitudinal struts and holes 20' that are made in connecting strut 21 at a lateral interval from one another. In this way also, the lateral separation between both actuation struts 9 and the relative position of connecting strut 21 can be adjusted and fixed in varying longitudinal direction relative to lateral actuation struts 9 and, further, mentioned shoulder padding 13 can also be adjusted and fixed in varying relative position.

FIG. 2 shows the rehabilitation device being worn. It can be seen from it that padded support 3 comes to lie on back 25 of a patient and there a swivel axis (articulation) running crosswise to the longitudinal direction of the body, i.e., generally in the standing position in the horizontal direction, forms the fulcrum and both upward-going, arc-shaped sections of actuation struts 9 run over the shoulders so that mentioned counter-supports 13 lie in each case on the left and right in the front shoulder area. By grasping release sections 27, which project on the bottom beyond support 3 downward and to the front, the rehabilitation device can be tipped around its horizontal swivel axis 29, formed by support 3, so that function unit 31 made above support 3 tilts associated counter-supports 13 according to arrows 33 toward the back. Likewise, for example, pull cords 35 can be attached to release sections 27 (for example to rings 28 that are made on the end of actuation struts 9) and be fastened at their other end for example to hooks 37 on a stationary wall 38 or the like, so that when the person in question moves backward slightly, the forward and/or upward swiveling motion of release sections 27 thus produced exerts the corresponding tipping movement and thus the pressure of counter-supports 13 on the front shoulder area and the hump back in the desired way.

This procedure thus presses padded elements 17 against the front right and left shoulder part and stretches the front chest and straightens the lateral (i.e., left and right) front shoulder part and simultaneously the hump back.

Figure 3:
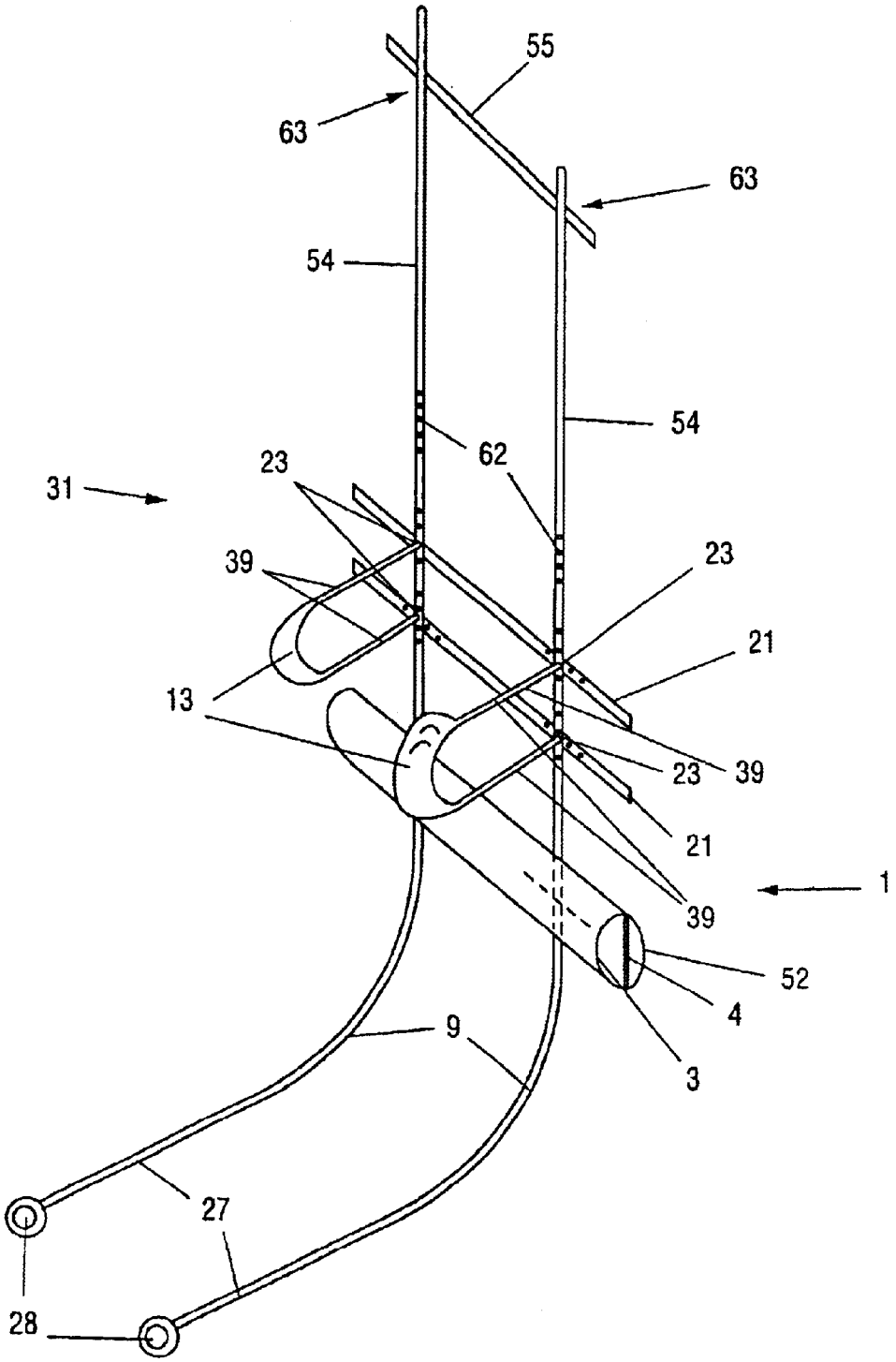
FIG. 3, an embodiment modified relative to FIG. 1.

A modification of the rehabilitation device is shown in FIG. 3.

It can be seen from the embodiment according to FIG. 3 that both laterally offset actuation struts 9 are not necessarily arc-shaped but, for example, can be constructed also only with one or more narrow arc sections or sharp curves. In this case, function unit 31 located above support 3 can exhibit not arc-shaped, but rather straight end sections of actuation struts 9. Actuation struts 9 can, in the rear area, thus be made vertical and straight. For further stabilization, two connecting struts 21 are provided above support 3, offset in the vertical direction and running crosswise, and they can also be fastened in their height position by suitable adjustment or fixing devices 23 in various relative positions (i.e., in the longitudinal direction of actuation struts 9 and/or with varying lateral displacement of both actuation struts). Attachment or fixing devices 23 can also consist of numerous correspondingly offset holes through which the corresponding screw and fixing means are inserted, as was explained based on the attachment of cross strut 7 with reference to FIG. 1.

Used as counter-supports 13 in this embodiment are shoulder straps that can be made as loops, belts, etc. Such a loop-shaped counter-support 13, made for example of textiles or leather, therefore does not need to be provided with any further padding elements 17. But of course, especially in the inner area of the loop, further padding can naturally be provided. When worn, the arms thus go through these loops and, by corresponding height adjustment of both crosswise-running connecting struts 21 and end sections 39 of the loops attached to them, the position of the loops can be adjusted optimally by varying height adjustment and fixing of cross struts 21 not only in the lateral distance to one another (by adjusting their fixing elements on connecting struts 21) but also in the desired height position relative to support 3.

Corresponding action on release sections 27 by grasping or pivoting or by the mentioned use, for example, of release cords 35 in turn produces the desired rocking and swiveling movement while generating the desired pressure to straighten the shoulder part and the hump back 30, and support 3 lies against the hump back to be treated, forming swivel axis 29.

Yet other additional particularities can be drawn from FIGS. 3 and 4, which will be discussed briefly below.

Figure 4:
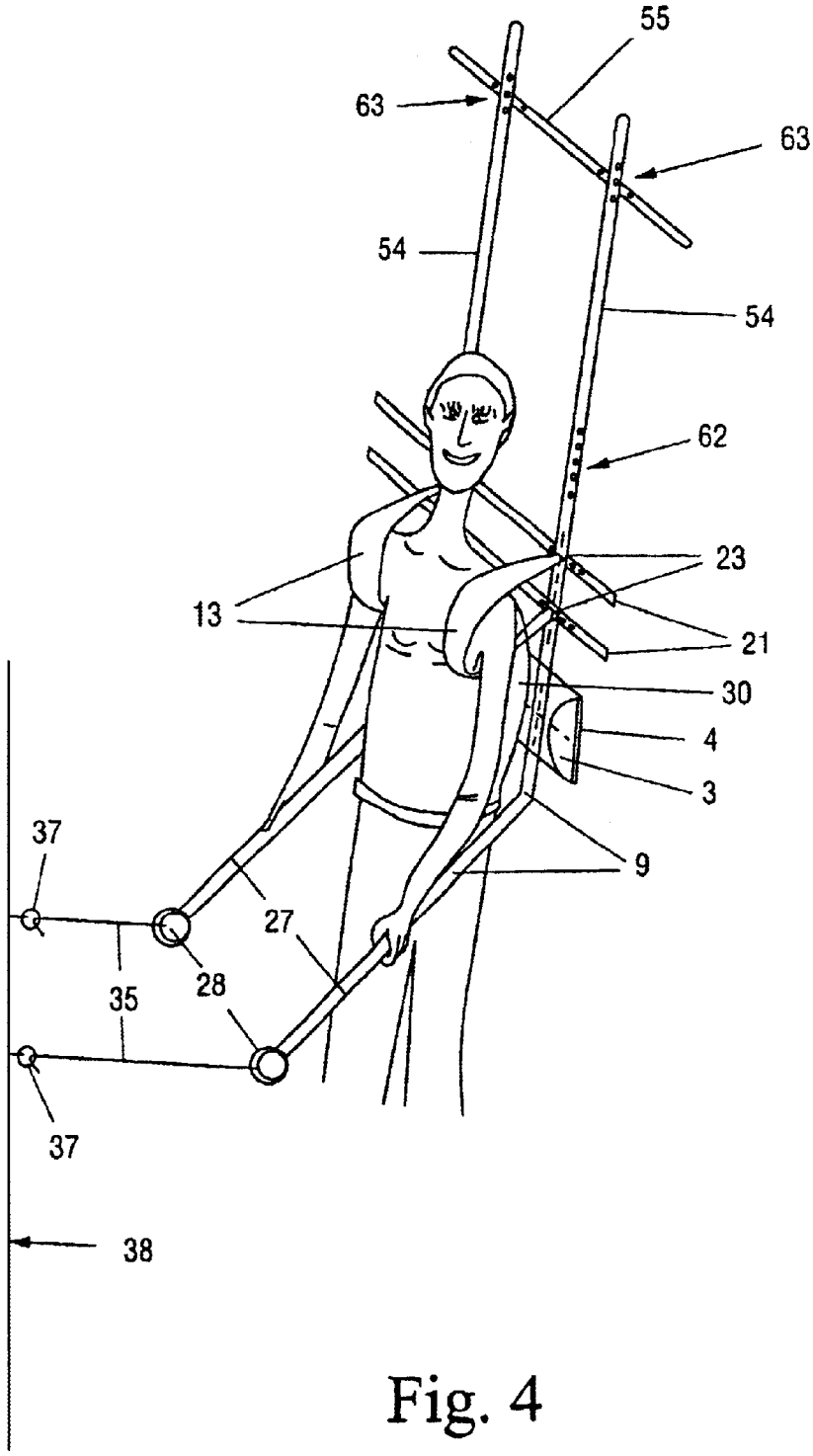
FIG. 4, the rehabilitation device shown in FIG. 3 placed on a patient.

Reference symbol 52 in FIGS. 3 and 4 reflects a semi-circular rear side of support 3 that makes it possible for this support to be used without the frame shown even during floor exercises, so that support 3 can be used as a tipping element for treatment while lying on the floor or even on a separate couch.

Reference symbol 53 further shows a bracing belt between counter-supports 13 and adjusting harness 45; 54 shows an elongated strut 9; 55 shows a cross strut for stabilizing elongated strut 54 and 62 shows an adjustable connection point that acts between the laterally offset struts running upward on the back and elongated struts 9 that can be attached to lengthen them, to be able to fix the latter in varying lengths.

Elongated struts 54, optionally with or without cross strut 55, can also be used, for example, to walk forward slowly toward a door until approximately in the door frame, until the elongated struts strike an upper door lintel. Going slightly forward or rocking also induces the corresponding forces on the front shoulder part and the hump back, to straighten them.

Only for the sake of clarity at this point will it be mentioned that the mentioned connecting points between the vertical and horizontal support struts can also exhibit, for example, adjustable connecting points at suitable places to be able to perform a faster alignment and precision adjustment according to individual needs with respect to the width adjustment or the height adjustment of the individual longitudinal struts and cross struts.

Figure 5:
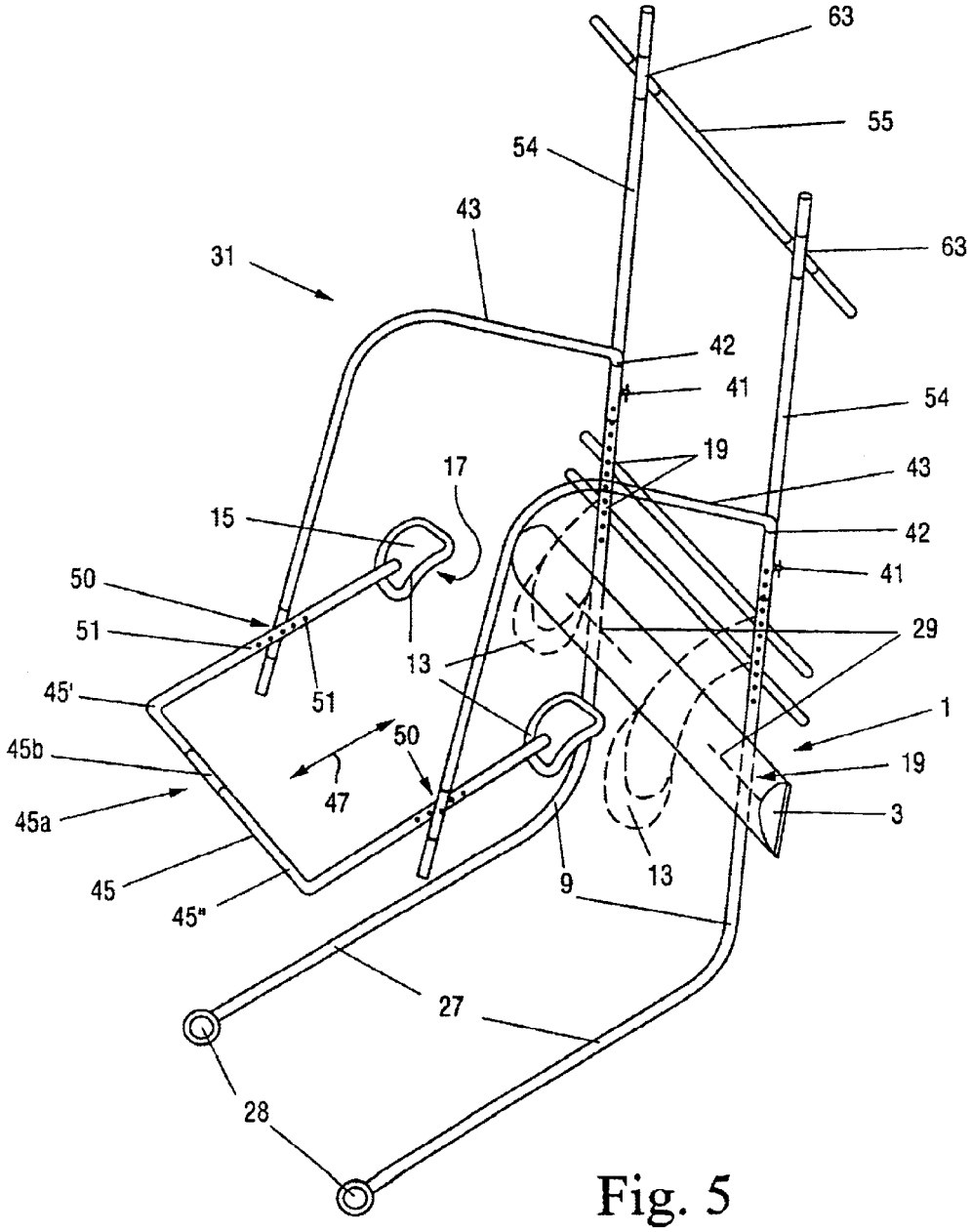
FIG. 5, another modified embodiment.
Figure 6:
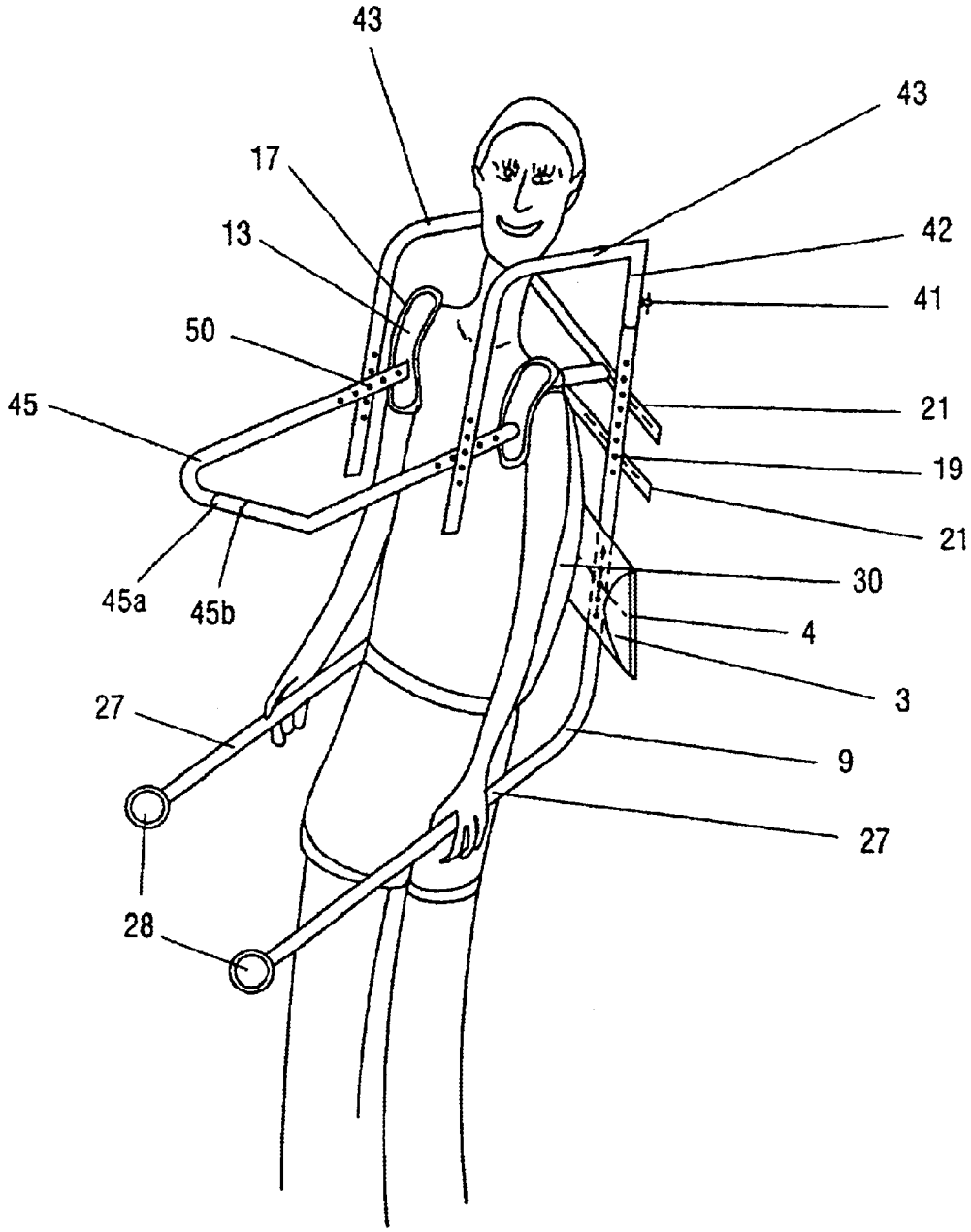
FIG. 6, the rehabilitation device shown in FIG. 5 placed on a patient.

The embodiment according to FIGS. 5 and 6 corresponds in its basic design to that according to FIGS. 3 and 4. In this embodiment, instead of the loop-shaped counter-supports still drawn in dashed lines in FIG. 5, the counter-support is made by additional, insertable or connectable supplementary harnesses. In this embodiment, straight actuation struts 9 are provided on their upper end with a corresponding plug junction 41 into which insertable end 42 of attachable strut 43, running in a large arc over the shoulders toward the front, is shown inserted, on whose front, downward running ends an adjustable harness 45, U-shaped in top view, is anchored at varying height. This adjustable harness 45 can further be anchored corresponding to arrow 47 in varying relative position so that counter-supports 13 located on its end can be adjusted in varying relative position closer or further in the direction of rearward support 3 by means of a go pressure support base 15 and padded elements 17 usually attached there. This design makes it possible for a patient to more easily put on the device since, because of the distance between attachable struts 43 and adjustable struts 45, enough open space is left so that the rehabilitation device made this way can be put on over the head.

Also the horizontal distance between both attachable struts 43 can, for example, be changed by pivoting them around their insert axes 41. To make it possible here to adapt to adjustable strut 45, adjustable strut 45 is divided into two parts and comprises two halves 45' and 45" of a U-shape that are provided on their base section **45*a* with a telescoping adapter section 45*b*** that can be inserted into, and pulled out from, one another.

Otherwise, adjustable strut 45 and/or attachable strut 43 are provided, in the area of their crossing points 50, with numerous holes 51 lying offset to one another in the longitudinal direction, which make it possible to fasten adjustable harness 45 and attachable struts 43 onto one another in varying height position and also in varying relative position with respect to arrow 47 according to individual requirements and wishes, for example also by the mentioned adjustment and fixing devices, e.g., consisting of screw bolts and nuts.

FIG. 6 here also shows that otherwise the further design and functioning is comparable to the preceding embodiments.

The fact that the vertical elongation using longitudinal struts 54 and connecting struts 55 can be provided only as an alternative, but does not have to be provided and can be inserted supplementarily in the other struts or again removed is shown, for example, based on FIG. 6, in which, departing from FIG. 5, vertical elongation struts 54 with connecting strut 55 are not shown.

Only for the sake of completeness is it mentioned that function unit 31 with the corresponding sections of actuation struts 9 or optionally provided attachable struts 43 or one or more adjustable struts 45 can also be designed so that these struts, starting from rear base section 1, can run not over the upper shoulder area but on the side, on the outside around the shoulder and arm area or even under the shoulder, and on each front shoulder area a corresponding counter-support can be made and/or fixed in various adjustment positions.

FIGS. 2 and 4 show that, on the lower end of actuation struts 9, cords 35 can be attached, for example to a stationary wall or a stationary piece of furniture, to induce the corresponding forces on the shoulder area and hump back by forward and rearward movement. Naturally, corresponding cords can also be attached above rocker-shaped support 3 on the so-called function unit and its free ends can also be attached to a wall or a closet. In this case, the patient need go only forward to induce the rearward-directed forces on the shoulder area to straighten the hump back. In this case, detachable sections 27 are placed above support 3 that forms swivel axis 29.

What is claimed is:

1. A rehabilitation device comprising:

a frame including two longitudinal actuation struts laterally offset to each other;

a crosswise support coupled between the pair of actuation struts and disposed in an orientation perpendicular to the longitudinal axis, the support forming a swivel axis;

a function unit including a pair of laterally offset counter supports disposed in a forward direction relative to and facing the support, wherein the support and the function unit are configured such that when the support is positioned adjacent a wearer's back, the counter supports are positioned adjacent respective front shoulder areas of the wearer; and an operation element operatively coupled with the frame and extending in the forward direction, the operation element being configured according to relative positions of the counter supports and the swivel axis to drive the counter supports toward the front shoulder areas about the swivel axis.

2. A rehabilitation device according to claim 1, wherein the operation element is disposed under the support.

3. A rehabilitation device according to claim 1, wherein the operation element comprises extensions of the actuation struts including a section going forward.

4. A rehabilitation device according to claim 3, wherein the sections going forward of the operation element are configured to be grasped by hands of the wearer.

5. A rehabilitation device according to claim 1, further comprising a release cord anchored as a pulling device to the operation element.

6. A rehabilitation device according to claim 1, wherein the counter-supports are disposed above the support and fastened directly or indirectly to the frame.

7. A rehabilitation device according to claim 1, wherein the counter-supports can be variably adjusted and fixed in their lateral distance and/or in their relative position with respect to the frame or to the support.

8. A rehabilitation device according to claim 1, wherein the function unit comprises extensions of the actuation struts and are arc-shaped in side view or made like an upside-down U.

9. A rehabilitation device according to claim 8, wherein the counter-supports are secured to the arc-shaped extensions.

10. A rehabilitation device according to claim 8, further comprising a connecting strut coupled between the extensions of the actuation struts, the counter-supports being secured to the connecting strut.

11. A rehabilitation device according to claim 10, wherein the counter-supports secured to the connecting strut are adjustable by an adjusting and fixing mechanism in varying lateral relative distance and/or the connecting strut is adjustable by an adjusting and fixing mechanism in varying longitudinal relative position with respect to the frame.

12. A rehabilitation device according to claim 10, further comprising an adjustable harness made in top view as a U-shaped adjustable strut, the adjustable harness including a base section that connects both actuation struts and can be adjusted in varying relative position.

13. A rehabilitation device according to claim 12, wherein the counter-supports are attached to exposed leg ends of the adjustable strut.

14. A rehabilitation device according to claim 1, further comprising attachable struts anchored on the frame.

15. A rehabilitation device according to claim 1, comprising several connecting struts secured between the actuation struts.

16. A rehabilitation device according to claim 1, wherein the actuation struts are configured the same in side view.

17. A rehabilitation device according to claim 1, wherein the counter-supports are fitted automatically to the respective shoulder part and can be swiveled at least over a certain angle range.

18. A rehabilitation device according to claim 1, wherein the counter-supports comprise a loop through which the wearer's arm can pass when worn.

19. A rehabilitation device according to claim 8, wherein the actuation struts are configured essentially in an arc shape broader than the arc shape of the function unit.

20. A rehabilitation device according to claim 3, wherein the actuation struts are essentially straight and transition in an arc section or a bent connection area to the extensions of the actuation struts.

21. A rehabilitation device according to claim 1, wherein the function unit is elongated with additional vertical struts and at least one additional cross strut serving as release devices.

22. A rehabilitation device comprising:

a frame including a pair of actuation struts each extending along a longitudinal axis;

a support coupled between the pair of actuation struts and disposed in an orientation perpendicular to the longitudinal axis, the support defining a swivel axis;

a function unit including a pair of counter supports disposed facing the support, wherein the support and the function unit are configured such that when the support is positioned adjacent a wearer's back, the counter supports are positioned adjacent respective front shoulder areas of the wearer; and an operation element operatively coupled with the frame and configured to drive the counter supports toward the front shoulder areas about the swivel axis, wherein connecting points between individual struts and strut parts are configured as adjustable connecting struts.

* * * * *